US007337555B2

(12) United States Patent
Uku et al.

(10) Patent No.: US 7,337,555 B2
(45) Date of Patent: Mar. 4, 2008

(54) MANUFACTURING METHOD AND CONTINUOUS DRYING APPARATUS FOR HEAD DECORATING REGENERATED COLLAGEN FIBER

(75) Inventors: Kyoji Uku, Hyogo (JP); Yoshihisa Dohno, Hyogo (JP); Kouji Ono, Okayama (JP)

(73) Assignee: Kaneka Corporation, Osaka (JP)

( * ) Notice: Subject to any disclaimer, the term of this patent is extended or adjusted under 35 U.S.C. 154(b) by 335 days.

(21) Appl. No.: 10/548,859

(22) PCT Filed: Mar. 18, 2004

(86) PCT No.: PCT/JP2004/003692

§ 371 (c)(1),
(2), (4) Date: Sep. 9, 2005

(87) PCT Pub. No.: WO2004/088018

PCT Pub. Date: Oct. 14, 2004

(65) Prior Publication Data

US 2006/0090368 A1 May 4, 2006

(30) Foreign Application Priority Data

Mar. 31, 2003 (JP) ..... 2003-093396

(51) Int. Cl.
*F26B 3/00* (2006.01)

(52) U.S. Cl. ..... 34/445; 34/618; 57/282

(58) Field of Classification Search ..... 34/447, 34/445, 482, 611, 618, 620, 627; 57/284, 57/28, 29, 282, 309; 428/364; 162/196, 162/197

See application file for complete search history.

(56) References Cited

U.S. PATENT DOCUMENTS 3,576,081 A * 4/1971 McCrary ..... 34/625

(Continued)

FOREIGN PATENT DOCUMENTS

EP 1 359 245 A1 11/2003

(Continued)

OTHER PUBLICATIONS

International Search Report from Corresponding International Application No. PCT/JP2004/003692, dated Aug. 3, 2004, 4 pages.

(Continued)

*Primary Examiner*—Kenneth Rinehart
(74) *Attorney, Agent, or Firm*—Brinks Hofer Gilson & Lione

(57) ABSTRACT

Provided is a method for manufacturing a regenerated collagen fiber and a drying apparatus therefor in a manufacturing process of a head decorating regenerated collagen fiber, the method enabling suppression of fluff (fiber breakage) and process trouble and providing outstanding curl retentive property and little hackling loss. Continuous drying is performed while controlling a tension of a fiber bundle under drying, the fiber bundle introduced into the drying apparatus having twists, using an apparatus having a mechanism wherein driven rollers are installed in an entrance and an exit, either of the driven rollers in the entrance and the exit is rotated at a constant speed, a fiber tension is detected with a tension detecting element installed in a drying chamber side of an exit driven roller, a rotational speed of the driven roller in another side is controlled so that an exit tension gives a desired value, and a freely rotatable roller is installed at a predetermined interval between the exit and the entrance.

6 Claims, 5 Drawing Sheets

U.S. PATENT DOCUMENTS

| | | | | | |
|---|---|---|---|---|---|
| 3,696,601 | A | * | 10/1972 | McCard | 57/285 |
| 3,816,993 | A | * | 6/1974 | McWaters | 57/309 |
| 4,614,044 | A | * | 9/1986 | Fiedler et al. | 34/445 |
| 5,174,046 | A | * | 12/1992 | Chern | 34/115 |
| 2004/0073010 | A1 | | 4/2004 | Ueda et al. | |

FOREIGN PATENT DOCUMENTS

| | | |
|---|---|---|
| JP | 49-9403 B1 | 3/1974 |
| WO | WO 02/052099 A1 | 7/2002 |

OTHER PUBLICATIONS

International Preliminary Report on Patentability (Chapter I of the Patent Cooperation Treaty) from Corresponding International Application No. PCT/JP2004/003692, dated Mar. 2, 2006, 6 pages.

* cited by examiner

MANUFACTURING METHOD AND CONTINUOUS DRYING APPARATUS FOR HEAD DECORATING REGENERATED COLLAGEN FIBER

RELATED APPLICATIONS

This application is a nationalization of PCT application PCT/JP2004/003692 filed on Mar. 18, 2004, claiming priority based on Japanese Application No. 2003-093396 filed on Mar. 31, 2003, the contents of which are incorporated herein by reference in their entirety.

TECHNICAL FIELD

The present invention is characterized by twisting a fiber bundle, and controlling a tension of the fiber bundle under drying to a desired value in manufacturing a head decorating regenerated collagen fiber for such as wigs and hair accessories, and it also relates to a method and an apparatus for preventing occurrence of fluff (fiber breakage), and continuously drying a regenerated collagen fiber having outstanding curl retentive property and little hackling loss.

BACKGROUND ART

Regenerated collagen fibers are generally manufactured, using hides and bones obtained from slaughtered animals as a raw material, telopeptides of collagen is decomposed and obtained the water soluble collagen by treating the materials with alkali or enzyme treatment, and then the obtained soluble collagen is spun into fibers. The spun fiber is then given various treatments according to usage. For example, performed is a treatment of combination of two methods using mono functional epoxy compounds and aluminum salts to the collagen (WO02/52099), and after the treatment, drying process is given in order to remove water included in the fiber.

Regenerated collagen fibers have properties of: having a very small tensile strength of fiber containing water before drying; giving easy occurrence of yarn breakage (fluff) under drying; showing shrinkage in drying but no stretchability; giving yarn breakage by compulsory stretching; and showing large unevenness in shrinking behavior according to drying conditions. Furthermore, there are problems that an excessively reduced tension under drying for fear of yarn breakage increases shrinkage of the regenerated collagen fiber under drying, and further fails to retain the curl retentive property as one of important quality of head decorating fibers at termination of drying, impairing commercial value thereof.

As drying conditions in batch methods, a drying method of regenerated collagen fibers is indicated by WO02/52099, wherein drying is preferably performed under conditions of drying temperatures of not more than 100 degree C. and more preferably not more than 75 more degree C. and a load of 0.01 to 0.25 g weight per 1 dtex, and preferably 0.02 to 0.15 g weight.

From the viewpoint of improving productivity, development of a continuous drying method and a device therefor is necessary, but there are problems of occurrence of fluff (yarn breakage) and tension control of a fiber running in a dryer etc., and therefore continuous drying of a regenerated collagen fiber is not yet in a situation of practical use.

In manufacturing of general synthetic fibers such as acrylic and polyamide fiber, these fibers differ from regenerated collagen fibers and thus allow stretching under drying and heat treatment. Therefore, under existing circumstances, general-purpose dryers of hot-air drying system using a plurality of driven rollers or heat rollers system may be used, and rotational speeds of the driven rollers are gradually increased in areas closer to an exit of the process, to dry the fibers accompanied with concurrent stretching in order to prevent hang-down of the fiber bundles in processes after drying including drying stage, or in order to adjust denier value (thickness) of a fiber, or in order to improve quality, such as strength. In contrast, regenerated collagen fibers can not allow stretching under drying, and compulsory stretching forms break of fiber bundles and causes resultant process trouble. Furthermore continuous drying without stretching makes the fiber bundles under drying give drying unevenness, forms difference in the shrinkage length in the fiber bundle, and forms resulting fiber bundle hang-down in a following drying step, thus leading to wound around rollers of the hung down bundle, and to slipping of the fiber out of the rollers. As a result, these disadvantages cause fiber breakage or breaking of the fiber bundle, and lead to situation of operation failure.

On the other hand, some prior art references indicate methods of continuous drying and apparatus using a fixed tension. For example, Japanese Patent Laid-Open No. 48-22710 gazette indicates an apparatus having a plurality of dryers for maintaining a low tension, and a plurality of driven rollers (yarn feeders) intervened therebetween, for the purpose of improvement in dimensional stability of cuprammonium rayon fibers.

However, adoption of this apparatus in drying of regenerated collagen fibers makes difficult maintenance of a fixed fiber tension between each of the driven rollers. The difficulties are attributed to the fact that drying shrinkage takes place immediately after the fibers come into falling rate drying region in drying of regenerated collagen fibers, and a change of drying conditions greatly varies shrinking behavior of the fibers, and makes difficult determination of a specified position of shrinkage of the fiber within the dryer, therefore shifting the shrinking position within the dryer. Accordingly, control of shrinking behavior of the fibers is very difficult to be adjust to a reduction ratio of the driven rollers, that is sections having a higher fiber tension and a lower one may be formed, a section having a higher fiber tension gives fiber breakage (fluff), and a section having a lower section gives fiber hang-down, leading to process trouble.

A document indicates a method using a plurality of Nelson rollers or tapered rollers with a fixed tension for drying, aiming at manufacturing a high modulus type PPTA fiber having few fluffs (Japanese Patent Laid-Open No. 60-88117 gazette). In the case where this apparatus is adopted for drying of regenerated collagen fibers, however, the above-described disadvantages make difficult adjustment of a tapered angle of the Nelson rollers or the tapered rollers with respect to shrinking behavior of the fibers, and therefore a section having a higher fiber tension gives fiber breakage (fluff), and a section having a lower section gives fiber hang-down.

Furthermore, a document indicates a manufacturing method of aiming at drying a high modulus fiber with outstanding abrasion-resistance under a fixed tension, wherein the fiber is passed on a heated roller (heat roller) and between rollers (Japanese Patent Laid-Open No. 04-214434 gazette). However, when these heat rollers used in drying regenerated collagen fibers, a usual straight drum type heat roller makes the fiber continuously shrink and raise a tension thereof as drying advances. As a result, control of tension becomes uncontrollable, leading to inevitable breaking of the fiber bundle (tow). Therefore, in the case of regenerated collagen fibers, use of the heat roller alone in continuous drying operation may not be adopted.

In addition, a certain method is found out that drying can be performed by controlling a rotational speed of a yarn guide roller and thus by controlling a stretching tension, aiming at manufacturing of a hollow fiber for cellulosic blood treatment having characteristic showing slight shrink in wet condition (Japanese Patent Laid-Open No. 57-14359 gazette). This apparatus is characterized by a structure of having a driven roller (yarn guide roller and taking up roller) currently installed in an entrance of the dryer, and also of a drying system of one pass having no rollers within the dryer. Here, in drying of regenerated collagen fibers, needed is at least 90 m for a residence length of the dryer calculated from viewpoints of operating condition (drying time not less than 30 minute) in consideration of quality and productivity (processing speed not less than 3 m/minute).

Accordingly, realization of a dryer having one pass of not less than 90 m either by horizontal or vertical type is very difficult, in consideration of conditions for installation construction cost, operability, etc., and therefore adoption a single passage dryer having no rollers within the dryer in drying for regenerated collagen fibers may not be practical.

As previously described, in manufacturing of head decorating regenerated collagen fibers, there have not yet been found out methods and apparatus enabling continuous drying, without any process trouble, of the regenerated collagen fibers having outstanding quality.

SUMMARY OF THE INVENTION

An object of the present invention is an industrially applicable continuous drying method and apparatus enabling manufacture of head decorating regenerated collagen fibers with outstanding quality, the method and apparatus causing no process trouble despite variation of shrinking behavior of the regenerated collagen fibers induced by drying under various conditions having different temperature, humidity, etc.

As a result of wholehearted investigations performed by the present inventors, it was found out that twists given with a predetermined rate to a fiber bundle introduced into a drying chamber, and furthermore drying under control within a certain range of a tension of the fiber bundle under drying enabled continuous drying of a regenerated collagen fiber, leading to completion of the present invention.

That is, the present invention relates to a method for manufacturing a head decorating regenerated collagen fiber, comprising the steps of: giving twists with a predetermined rate to a fiber bundle introduced into a drying chamber; and continuously drying the fiber bundle by controlling a tension of the fiber bundle so that the fiber bundle under drying gives a tension in a range of 0.01 to 0.08 g weight/dtex. Here, a count of twists given to the fiber bundle is preferably 0.2 to 5 twists/m. At this time, a value of a tension at an exit side of a drying chamber is preferably controlled within a range of 0.02 to 0.08 g weight/dtex.

Furthermore, the present invention relates to a continuous drying apparatus comprising a mechanism for controlling a rotational speed of a driven roller so that an exit tension gives a desired value, the continuous drying apparatus having driven rollers installed in an exit and an entrance of a drying chamber, wherein either of the drive rollers in the exit or the entrance is rotated with a constant speed, a fiber tension is detected with a tension detecting element installed in a drying chamber side of an exit driven roller, a rotational speed of the driven roller in another side is controlled, further comprising at least one freely rotatable rollers for at least one time of round-trip of a fiber bundle, the rollers installed with a predetermined distance between the entrance and the exit within the drying chamber.

The present invention will, hereinafter, be described in more details. Head decorating regenerated collagen fibers of the present invention include, for example, a regenerated collagen fiber obtained in a manner that after solubilized collagen is properly treated with acids if necessary, the solubilized collagen is extruded through a spinning nozzle or a slit into an aqueous solution comprising one or more kinds of mineral salts, such as sodium sulfate, sodium chloride, ammonium sulfate, etc., pH thereof being appropriately adjusted with sodium hydroxide, boric acid, sodium hydrogencarbonate, sodium lactate, disodium hydrogen phosphate, etc. to obtain a fibrous material, and the fibrous material is then converted into water-resistant by treatment with a mono-organic functional epoxy compound, an aluminum salt, etc. (refer to WO02/52099.) The present invention is also applicable to other head decorating regenerated collagen fibers.

Here, properties of regenerated collagen fibers will be described. FIG. 1 shows an example of shrinking behavior of a regenerated collagen fiber under batch drying. FIG. 1 shows that a regenerated collagen fiber rapidly shrinks immediately after it comes in a falling rate drying region, which is a region where water content of the fiber drops to 50 to 70 wt %-drybase. Therefore, in continuous drying, a percentage of shrinkage of the regenerated collagen fiber is dependent on a position within the continuous drying apparatus. In addition, since this shrinking behavior greatly varies with drying conditions, a position of the fiber shrinking moves within the drying apparatus according to drying conditions.

Furthermore, although regenerated collagen fiber may show shrinking under drying process, it does not allow stretching under drying, and it gives breakage by compulsory stretching. Then, excessive reduction of a tension under drying for preventing fiber breakage increases shrinkage of a product after termination of drying, and does not allow developing of curl retentive property that are one of important qualities of head decorating fibers, resulting in deterioration of commercial value thereof. Furthermore, continuous drying of the fiber bundle without any modification induces drying unevenness, and, as a result, generates fiber hang-down in a latter half of the drying process. In addition, the fiber hung-down may be wound around rollers, and may slip out of the rollers, thus leading to fiber breakage and tow (fiber bundle) breakage.

Drying unevenness as used herein represents a phenomenon that a fiber on a surface of a fiber bundle dries more quickly, and consequently shrinks, than a fiber located in an inside portion of the fiber bundle. When the drying unevenness happens, only fibers on a shrunk surface of the fiber bundle must support a tension of whole of the fiber bundle, and therefore drying is conducted in a state having a higher tension applied substantially only to fibers on the surface of fiber bundle. As a result, a fiber dried quickly has a smaller shrinkage, and has a longer fiber length in a latter half of the drying process as compared with a fiber of the inside part of the fiber bundles, therefore, resulting in fiber hang-down caused in the latter half of the drying process. Although fibers that allows stretching like common chemical fibers can prevent fiber hang-down using gradual stretching under drying, this method cannot be used in the case of regenerated collagen fibers that does not allow stretching.

The present invention solves the problem by applying twists to fiber bundles introduced into a drying chamber, and by controlling a tension of the fiber bundle under drying in case of continuous drying of regenerated collagen fibers having previously described properties. In the present invention, an amount of filaments in the fiber bundle in drying preferably is not more than 5000 filaments. A number of filaments exceeding the number described above enlarges a thickness of fiber bundle, and is apt to excessively increase drying unevenness between a surface portion of the fiber bundle and a central portion.

In the present invention, methods of applying a fixed count of twists to fiber bundle are not in particular limited. There may be mentioned a method to introduce a fiber bundle with a constant speed into a container rotating at a constant speed, and a method to introduce a fiber bundle contained in a container rotating at a constant speed into a dryer, and either of the methods may be adopted. Numbers of twists preferable for drying is 0.2 twists/m to 5 twists/m. Numbers of twists less than 0.2 twists/m applied to the fiber bundle deteriorates convergence of the fiber bundle, and disables sufficient suppression of fiber hang-down caused by drying unevenness, as a result leading to occurrence of fiber breakage or process trouble. On the other hand, although the count of twists more than 5 twists/m advantageously improves convergence of the fiber bundle and can prevent fiber hang-down, it makes twisted wave shape remain in the dried fiber, and sometimes makes the fiber unusable for usage needing straight style.

Furthermore, in the present invention, a tension of the fiber bundle under drying needs to be controlled and fiber drying needs to be performed so that the tension is within a range of 0.01 to 0.08 g weight/dtex in whole of treating process. When some portion of the fiber bundles under drying have a tension of less than 0.01 g weight/dtex, the portion may give a hang-down of the fiber bundle and of a fiber, the fiber hung-down may be wound around rollers, and may slip out of the rollers, causing process trouble. Furthermore, quality of the regenerated collagen fiber after drying, especially curl retentive property may be damaged. When some portion of the fiber bundles under drying have a tension of exceeding 0.08 g weight/dtex, a load is applied to the portion to occur possible fiber breakage.

In the present invention, methods of controlling a tension of a fiber bundle under drying within a range of 0.01 to 0.08 g weight/dtex are not particularly limited, and any methods may be used. When a continuous drying apparatus having a combination of a driven roller and a free roller described below is used, gradual increase in the tension value of the fiber bundle within the dryer from an entrance to an exit of the dryer will be attained. Therefore, control of the tension value using the driven roller in the dryer exit advantageously enables realization of a tension with a requested value of whole of the fiber bundle within the dryer. Hereinafter, a preferable continuous drying apparatus used in a manufacturing method of the present invention and a method of using the continuous drying apparatus will be described.

FIG. 2 schematically shows a preferable continuous drying apparatus of the present invention. Driven rollers 4 and 8 are installed in an entrance, and in an exit side of a drying chamber 7. The driven rollers can freely control a feeding speed of a fiber bundle by a rotational speed, preferably can suppress slip of the fiber bundle, and more preferably can prevent slip of the fiber bundle. That is, these driven rollers may be a multiple rollers that prevent slip using friction between a fiber and a roller surface, and may be nip rollers of a structure having a roller covered with rubber materials pressed onto a metallic roller. In addition, the multiple rollers and the nip rollers may be used in combination.

Between the entrance and the exit of the drying chamber 7, freely rotatable free rollers 6 are installed at a predetermined interval. A free roller as used herein is defined as a roller having a small frictional resistance of rotation. Generally, as a fiber bundle travels to an entrance from an exit of a drying chamber, a tension of the fiber bundle gradually decreases, and an amount of decrease of the tension is decided based on a magnitude of a frictional resistance of bearings of the free roller. A free roller used in the present invention has preferably an amount of decrease in a tension represented by (amount of decrease in tension per free roller)×(number of free rollers) of not more than 0.03 g weight/dtex. When a driven roller that is used for drying of general fibers is installed instead of a free roller here, increase in a tension may be observed in a section where the fibers greatly shrink, leading to occurrence of fluff (fiber breakage).

Furthermore, change of drying conditions greatly varies shrinking behavior of the fiber, and will shift a shrinking position of the fiber within the drying chamber. Therefore this shifting of the position makes very difficult correspondence between shrinking behavior of the fiber and a reduction ratio of a driven roller installed within the drying chamber, and also makes significantly difficult maintenance of a uniform tension of the fiber within the drying chamber. However, installation of freely rotatable rollers as in the present invention disperses a tension, enables control of a fiber tension in the dryer lower than a tension in an exit, and also enables control of a tension difference between tensions in the entrance and the exit smaller, even when shrinking of the fiber starts in any position from the entrance to the exit.

In the present invention, a rotational speed of either of driven rollers in an entrance and an exit is uniformly controlled, a signal is detected with a tension detecting element 5 installed in a drying chamber side of the exit driven roller, and thereby a rotational speed of another side driven roller is controlled so that an exit side tension value of a fiber gives a constant value. Drying under such managed conditions can control a tension of the whole fiber bundle under drying. General methods including PID control may be used as a controlling method of the tension. PID control is one of control actions performed with a control device in automatic control systems, and a proportional control action, integral action, and derivative control action are used in combination.

In the present invention, a value of exit tension of the drying chamber is preferably controlled within a range of 0.02 to 0.08 g weight/dtex from a viewpoint of a number of fluff (a number of fiber breakage), an amount of hackling loss, and curl retentive property of finished products. On one hand, an exit tension controlled higher than 0.08 g weight/dtex gives fluff (fiber breakage), and causes process trouble, and simultaneously increases an amount of hackling loss. On the other hand, an exit tension of the drying chamber controlled lower than 0.02 g weight/dtex does not permit developing of curl retentive property as one of important quality of head decorating fibers. In addition, when a free roller realizing a preferable amount of decrease in the tension is installed, control of a value of the exit tension of the drying chamber within a range of 0.02 to 0.08 g weight/dtex enables control of the tension over whole of the fiber bundle under drying within a range of 0.01 to 0.08 g weight/dtex.

Since a drying unevenness between outside and inside of the fiber bundle becomes larger as a drying temperature is higher, a temperature in the continuous drying is preferably not more than 100 degree C. and more preferably not more than 80 degree C. Although not limited particularly for lower limit of temperature conditions, it is quite natural that drying takes longer period with excessively low temperatures.

As described above, the present invention is characterized in that it can control a fiber tension under drying to a desired value, even when shrinking behavior of a regenerated collagen fiber is varied by different drying conditions of temperatures and humidity. Control of the fiber tension using a continuous drying apparatus of the present invention enables control of a tension of fiber bundles traveling within a drying chamber lower than an exit tension of the drying chamber, and also enables suppression of a tension difference between the entrance and the exit. As the result, the present invention can prevent occurrence of fluff (fiber breakage), can prevent process trouble, and simultaneously can realize continuous production of a head decorating regenerated collagen fiber having outstanding curl retentive property and little hackling loss.

EXAMPLE

Figure 3:
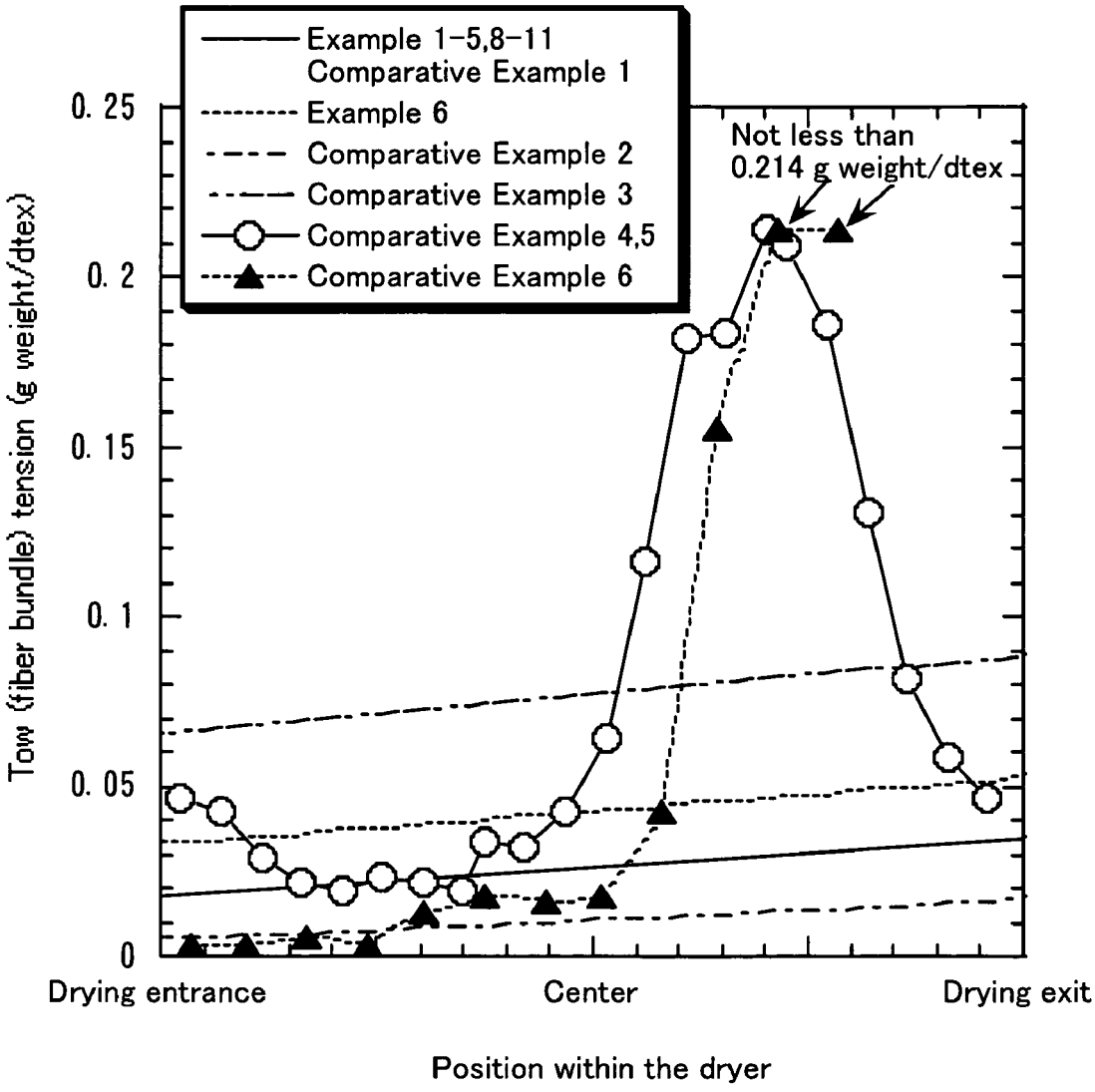
FIG. 3 shows a tension variation of a fiber bundle in a drying apparatus (under drying)

The present invention will, hereinafter, be described in more details with reference to Examples, but the present invention is not limited to these Examples. Table 1 and Table 2 show relationships between drying conditions, and a number of fluff (a number of fiber breakage), a hackling loss rate and curl retentive property in Examples and Comparative Examples. FIG. 3 shows tension unevenness of fiber bundles (under drying) within drying apparatuses in the Examples and Comparative Examples. Regenerated collagen fibers used for drying was manufactured according to the method disclosed in WO02/52099. Preparatory to description of Examples and Comparative Examples, a measurement and evaluation method of a shrinkage percentage of a fiber, curl retentive property, a number of fluffs (a number of fiber breakage), and hackling loss rate will be described.

(Shrinkage of a Fiber)

A fiber length $L_0$ per unit time introduced into a drying entrance and a fiber length $L_1$ per unit time leaving from a drying exit were measured for.

Fiber shrinkage was calculated with a following equation.

$$\text{Fiber shrinkage (\%)}=((L_0-L_1)/(L_0))\times 100$$

(Curl Retentive Property)

Formation of curl and measurement of curl retentive property were conducted by following steps.

(1) A well-loosened fiber bundle (6.3 g/58.4 cm) was combed to form a new bundle with a length of 66 cm fiber length, and a seam was given with a sewing machine in a center of the new bundle to give a tress having a fiber length of 33 cm and width of 12 cm.

(2) The tress was kept hung in an atmosphere of 25 degree C. and 80% RH for not less than 12 hours.

(3) The tress was folded four times to give a 3 cm of width, the bundle was then twisted once per 1 pitch onto a pipe made of aluminum having 12 mm of outside diameter, and subsequently both ends thereof were firmly fixed with a rubber band so that the fiber bundle might not shift.

(4) The pipe having the fiber bundle wound was introduced into a steam setter (made by Hirayama Seisakusho factory: HA-300P), and the tress was moisturized for 4 hours at 80 degree C. Subsequently, the tress was immersed in an aqueous solution of a silicon based oil (0.44 wt %) for 5 minutes, and dried at 90 degree C. for 1 hour in a hot wind convection type dryer (made by Tabai Espec Co., Ltd.: PV-221), and then kept standing for cooling.

(5) The treated tress was removed from the pipe made of aluminum, was unbound in the aqueous solution of the silicon based oil (0.0.44 wt %), and curling form was arranged on a net.

Subsequently, it was dried at 50 degree C. in a hot wind convection type dryer for 2 hours.

(6) The obtained tress was shampooed in following procedures.

1) A half amount of one-pumped amount of a shampoo (manufactured by Shiseido Co. Ltd.: Super Mild Shampoo/Floral Fruity) was sampled in a hand.
2) The shampoo was applied to the tress, and washed by rubbing with hands 10 times.
3) The tress was rinsed in warm water at 40 degree C.
4) The tress was squeezed well to remove water.
5) The tress was hung, and combed 10 times with hand.
6) Again, a hair root portion, middle portion, and end portion of the tress were gripped well.
7) The tress was sandwiched with a towel to absorb moisture.
8) The tress was combed 3 times with hand.
9) The tress was hung and dried at 50 degree C. for 90 minutes.

(7) Curl retentive property against shampooing (retentive property of curl form to a number of times of repeated shampooing) was evaluated as follows.

After operation of the above described (6) was repeated 3 times, it was observed whether curl form was maintained. Evaluation was performed in accordance with following criteria.

A: Satisfactory curl form retained
B: Curl form slightly deteriorated
C: Curl form hardly observed (Number of Fluff (a Number of Fiber Breakage))

A number of fiber breakages existing per 72 m of fiber bundles with 700 filaments were visually observed at an exit of a drying chamber. A number of not more than 36 was considered acceptable.

(Hackling Loss Rate)

A fiber bundle having a length of 70 cm and 44800 filaments was prepared. The fiber bundle was kept standing in an environment of a temperature of 20±2 degree C. and a humidity 65±2% RH. Subsequently, the fiber bundle was hackled totally 100 times: 50 times from one side 50 times from another side. A hackling loss rate was calculated with following formula from a weight $W_0$ before hackling, and a weight $W_1$ after hackling. A value not more than 1.0% was considered acceptable.

$$\text{Hackling loss rate (\%)}=((W_0-W_1)/W_0)\times 100$$

Example 1

Figure 1:
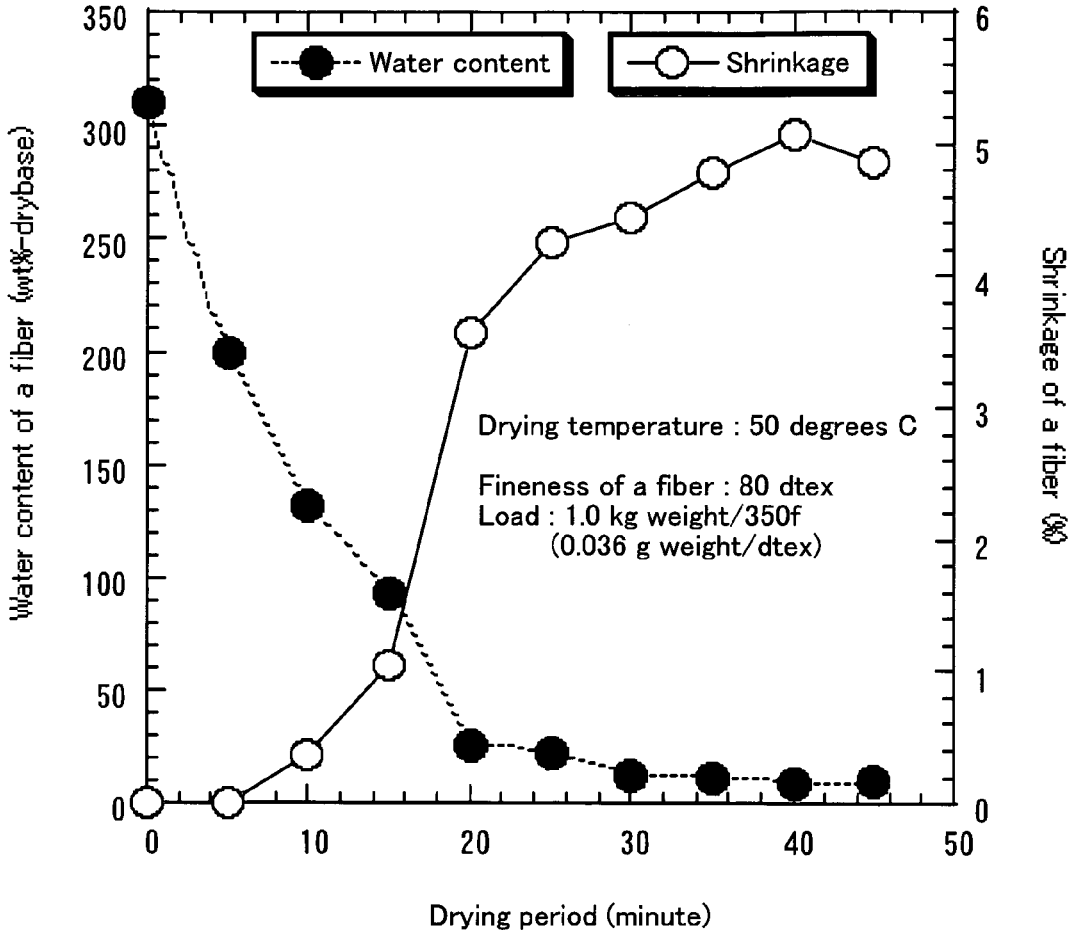
FIG. 1 shows unevenness with time (shrinking behavior of a fiber) of a fiber shrinkage and a water content in a batch drying.
Figure 2:
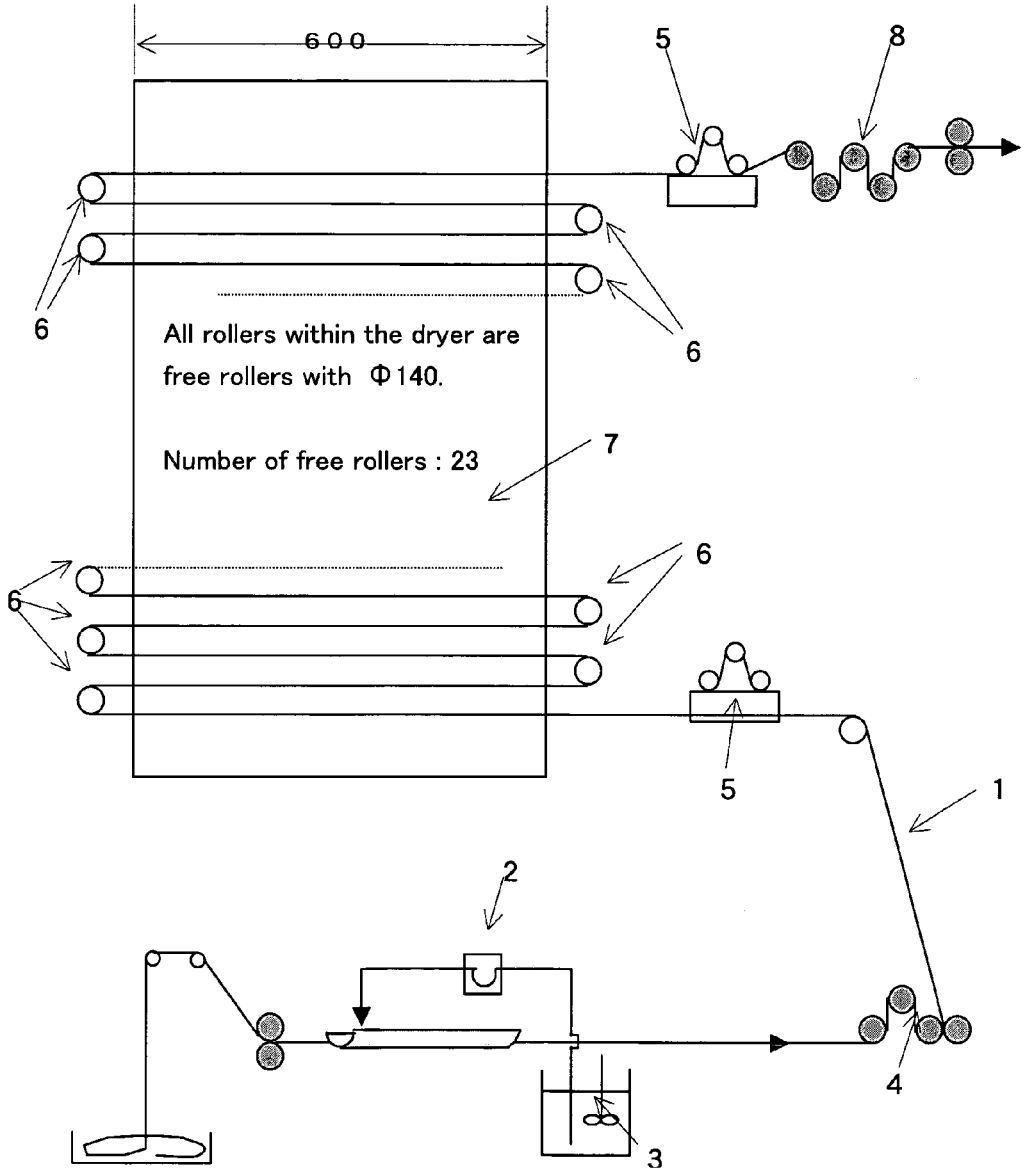
FIG. 2 is a schematic view of a drying apparatus of free roller configuration (Examples 1 to 11, Comparative Examples 1 to 3)

FIG. 2 shows a schematic view of a drying apparatus used in the Example. In a drying chamber 7, 23 free rollers 6 having a diameter of 140 mm, a length of 500 mm and shaft diameter of 25 mm (bearing: product name 6005ZE C3 NACHI) were installed at intervals of 6 m to set a residence length as 144 m (6 m×24 paths) In order to prevent slip of fiber bundles, installed were driven rollers 4 and 8 having multiple rollers and nip rollers used in combination at an entrance and an exit of a drying chamber, and hot wind having a fixed wind velocity was blown into the drying chamber. In addition, tension detecting elements 5 (LX-TD type tension detecting element: made by Mitsubishi Electric Corporation) were installed around the entrance and the exit of the drying chamber, and a signal taken out from the exit side tension detecting element performed PID control of a rotational speed of an exit driven roller so that a tension value at the exit side might give a constant value. Drying conditions were controlled so that a temperature might give 65 degree C. and an exit side tension 0.036 g weight/dtex (20 N/700 f). An entrance side tension at that time gave 0.018 g weight/dtex (10 N/700 f).

As shown in FIG. 3, the tension is gradually decreased from the exit to the entrance, and this decrease is based on a frictional resistance of bearings generated when free rollers rotate. Four fiber bundles having 700 filaments were introduced into the drying apparatus, and twists was given to each of the fiber bundles with a ratio of 0.5 twists/m. A fineness of a single fiber gave 80 dtex, a thickness of the fiber bundle 56000 dtex, and a gross size 224000 dtex.

The shrinkage of the regenerated collagen fiber dried under the above-described conditions gave 7%, a number of fluff (fiber breakage) at the drying chamber exit 8 times/700 f×72 m, and a hackling loss rate 0.1%. All of these evaluations exceeded acceptance criteria, and curl retentive property were also satisfactory (refer to Table 1).

Example 2

Experiment was conducted in a same manner as in Example 1 except for having changed a count of twists of 0.5 twists/m into 1.0 twists/m. As a result, fiber shrinkage gave 7% and a number of fluff (fiber breakage) and hackling loss rate exceeded acceptance criteria, and curl retentive property was also satisfactory.

Example 3

Experiment was conducted in a same manner as in Example 1 except for having changed a count of twists of 0.5 twists/m into 0.25 twists/m. As a result, fiber shrinkage gave 7%. Convergence of the fiber bundle was inferior as compared with Example 1, a number of fluff (fiber breakage) gave 30 times and a hackling loss rate increased to 0.3%, a number of fluff and a hackling loss rate exceeded acceptance criteria, and curl retentive property was also satisfactory.

Example 4

Experiment was conducted in a same manner as in Example 1 except for having changed a drying temperature of 65 degree C. into 50 degree C. As a result, fiber shrinkage gave 5%. A number of fluff (fiber breakage) and a hackling loss rate exceeded acceptance criteria, and curl retentive property was also satisfactory.

Example 5

Experiment was conducted in a same manner as in Example 1 except for having changed a drying temperature of 65 degree C. into 75 degree C. As a result, fiber shrinkage gave 8%. A number of fluff (fiber breakage) and a hackling loss rate exceeded acceptance criteria, and curl retentive property was also satisfactory.

Example 6

Experiment was conducted in a same manner as in Example 1 except for having changed the exit side tension of 0.036 g weight/dtex (20 N/700 f) into 0.054 g weight/dtex (30 N/700 f). As a result, an entrance side tension gave 0.034 g weight/dtex (19 N/700 f), and the tension was gradually decreased from the exit to the entrance as shown in FIG. 3. Fiber shrinkage gave 6%. A number of fluff (fiber breakage) and a hackling loss rate exceeded acceptance criteria, and curl retentive property was also satisfactory.

Example 7

Experiment was conducted in a same manner as in Example 1 except for having changed the exit side tension of 0.036 g weight/dtex (20 N/700 f) into 0.071 g weight/dtex (40 N/700 f). As a result, an entrance side tension gave 0.050 g weight/dtex (28 N/700 f), and the tension was gradually decreased from the exit to the entrance. Fiber shrinkage gave 4%. Since the fiber tension became higher as compared with that in Example 1 and a number of fluff (fiber breakage) increased to 33 and a hackling loss rate increased to 0.4%, but a number of fluff and a hackling loss rate exceeded acceptance criteria, and curl retentive property was also satisfactory.

Example 8

Experiment was conducted in a same manner as in Example 1 except for having introduced one fiber bundle with 2800 filaments into the drying apparatus. As a result, larger drying unevenness and small level of drop of convergency of the fiber bundle increased a number of fluff (fiber breakage) and hackling loss rate as compared with those in Example 1, but both evaluations exceeded acceptance criteria and curl retentive property was also satisfactory.

Example 9

Experiment was conducted in a same manner as in Example 1 except for having carried out PID control of the rotational speed of the entrance driven roller so that a tension value at the exit side might give a constant value. As a result, fiber shrinkage gave 7%, a number of fluff (fiber breakage) and hackling loss rate exceeded acceptance criteria, and curl retentive property were also satisfactory.

TABLE 1

Relationship between drying conditions, and the number of fluff (the number of fiber breakage), hackling loss rate and curl retentive property in Examples 1 to 9

| Roll configuration in a dryer | | Count of twists (twists/m) | Drying temperature (degree C.) | Tension of a fiber bundle (g weight/dtex) Entrance tension | Exit tension | Minimum tension | Maximum tension | Fiber shrinkage at exit of drying (%) | Number of fluff (fiber breakage) (times/700 f * 72 m), Acceptance criterion: not more than 36 | Hackling loss rate (%) Acceptance criterion: not more than 1.0% | Curl retentive property |
|---|---|---|---|---|---|---|---|---|---|---|---|
| Free roller | Example 1 | 0.5 | 65 | 0.018 (10) | 0.036 (20) | 0.018 (10) | 0.036 <20) | 7 | 8 | 0.1 | A |
| | Example 2 | 1.0 | 65 | 0.018 (10) | 0.036 (20) | 0.018 (10) | 0.036 (20) | 7 | 6 | 0.1 | A |
| | Example 3 | 0.25 | 65 | 0.018 (10) | 0.036 (20) | 0.018 (10) | 0.036 (20) | 7 | 30 | 0.3 | A |
| | Example 4 | 0.5 | 50 | 0.018 <10) | 0.036 (20) | 0.018 (10) | 0.036 (20) | 5 | 6 | 0.1 | A |
| | Example 5 | 0.5 | 75 | 0.018 (10) | 0.036 (20) | 0.018 (10) | 0.036 (20) | 8 | 18 | 0.2 | A |
| | Example 6 | 0.5 | 65 | 0.034 (19) | 0.054 (30) | 0.034 (19) | 0.054 (30) | 6 | 20 | 0.2 | A |
| | Example 7 | 0.5 | 65 | 0.050 (28) | 0.071 (40) | 0.050 (28) | 0.071 (40) | 4 | 33 | 0.4 | A |
| | Example 8 | 0.5 | 65 | 0.018 (10) | 0.036 (20) | 0.018 (10) | 0.036 (20) | 7 | 23 | 0.2 | A |
| | Example 9 | 0.5 | 65 | 0.018 (10) | 0.036 (20) | 0.018 (10) | 0.036 (20) | 7 | 9 | 0.1 | A |

Tension of fiber bundle: ( ) Unit of numerical value N/700 f

Comparative Example 1

Experiment was conducted in a same manner as in Example 1 except for having changed a count of twists of 0.5 twists/m into 0 twists/m (with no twist). As a result, although Example 1 did not give fiber hang-down at all, the Comparative Example 1 gave fiber hang-down in a latter half of drying process. The hung down fiber wound around rollers, and slipped off the rollers, and fiber breakage occurred, leading to breaking of the fiber bundle (tow), and interruption of operation in the middle of experiment. Evaluation carried out up to breaking of the fiber bundle gave approximately 200 times/700 f×72 m of a number of fluff (fiber breakage) in drying exit, and a hackling loss rate of 5.2%, failing to reach to acceptance criteria.

Example 10

Experiment was conducted in a same manner as in Example 1 except for having changed a number of twists of 0.5 twists/m into 0.17 twists/m. As a result, although this Example 10 gave fiber hang-down in a latter half of a drying process to a slight degree as compared with Comparative Example 1, continuous running of experiment was possible.

Example 11

Experiment was conducted in a same manner as in Example 1 except for having changed a number of twists of 0.5 twists/m into 10 twists/m. As a result, this Example 11 gave a high convergency of fiber bundle, a number of fluff and hackling loss rate exceeded acceptance standard, and curl retentive property was also satisfactory. However, since many twists in the fiber bundle left slight twists in the obtained dried fiber.

Comparative Example 2

Experiment was conducted in a same manner as in Example 1 except for having changed an exit side tension 0.036 g weight/dtex (20 N/700 f) into 0.018 g weight/dtex (10 N/700 f). As a result, an entrance tension gave 0.005 g weight/dtex (3 N/700 f), and the tension was gradually decreased toward the entrance from the exit, as shown in FIG. 2. The fiber shrinkage gave a high value of 11%. Since the tension gave a low value, a number of fluff (fiber breakage) and hackling loss rate exceeded acceptance criteria. However, since the shrinkage under drying became higher, curl retentive property gave a lower value.

Comparative Example 3

Experiment was conducted in a same manner as in Example 1 except for having changed an exit side tension of 0.036 g weight/dtex (20 N/700 f) into 0.089 g weight/dtex (50 N/700 f). As a result, an entrance tension gave a high value of 0.066 g weight/dtex (37 N/700 f) (refer to FIG. 3), and the fiber shrinkage also gave a low value of 2%. A number of fluff (fiber breakage) in the drying exit gave a value of approximately 150 times/700 f×72 m, and a hackling loss rate gave a value of 4.0%, leading to failure to reach to acceptance criteria.

Comparative Example 4

Figure 4:
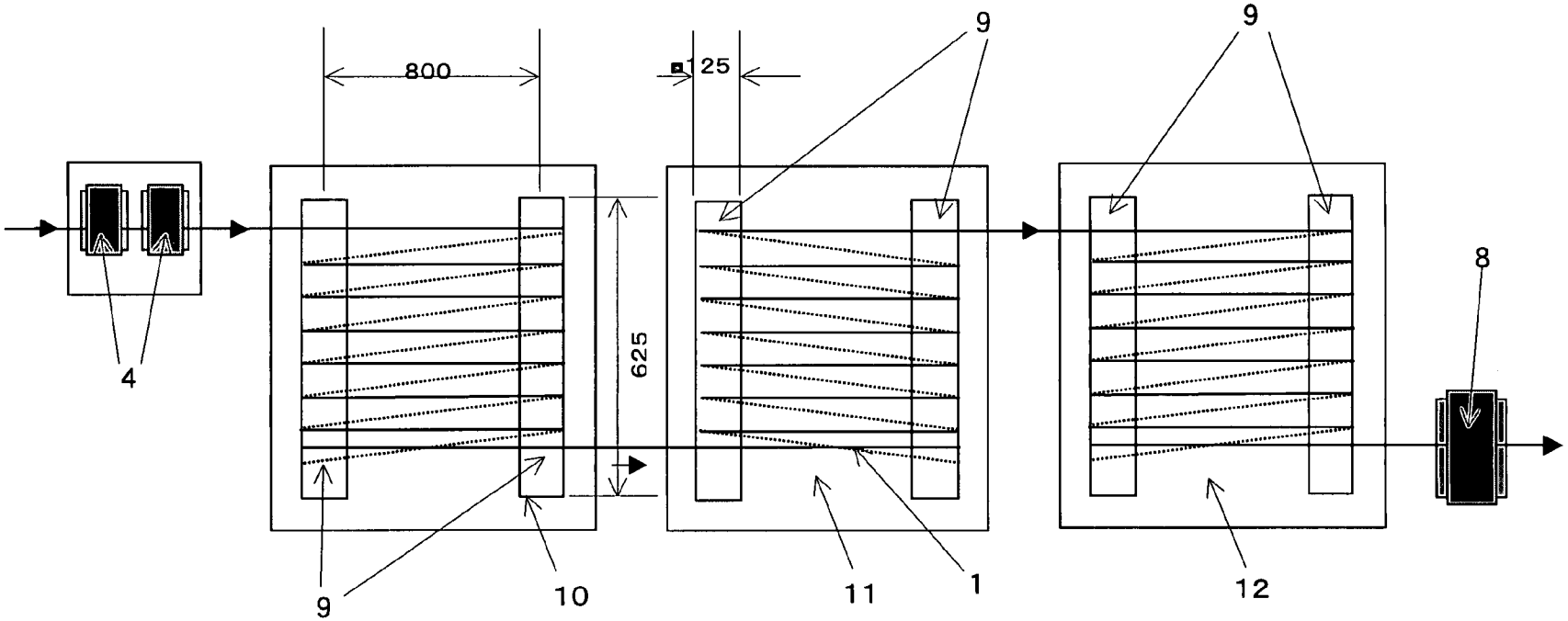
FIG. 4 is a schematic view where three sets of Nelson dryers are connected together (Comparative Example 4)

FIG. 4 shows a schematic view of a Nelson dryer. Experiment was conducted using three Nelson dryers 10, 11, and 12 having tapered rollers 9 with a diameter of 125 mm and a length of 625 mm connected together. Distances between rollers within each dryer were set as 800 mm, a tow (fiber bundle) was made to reside with 7.5 turns, and hot air at a constant velocity was blown in to perform drying process. All Nelson rollers 9 of three sets of each dryer were adjusted to have tapered angles so as to give the shrinkage of 2.4%.

Thereby, the shrinkage of the fiber at drying exit of three connected dryers gave 7.0%. Drying temperature was set as 65 degree C. The fiber bundle introduced into the dryer had 700 filaments, and a twist was applied at a ratio of 0.5 twists/m. A fineness of a single fiber was 80 dtex, and a thickness of a fiber bundle was 56000 dtex.

As shown in FIG. 3, a tension in the dryer increased rapidly to 0.214 g weight/dtex (120 N/700 f) in a position where the fiber in a falling rate drying region remarkably shrinks. As a result, although this Comparative Example 4 gave the shrinkage of the fiber at the drying exit a same value of 7% as in Example 1, fiber breakage occurred within the dryer. A number of fluff gave 300 times/700 f×72 m, and a hackling loss rate gave a very large value of 7.8%, failing to reach to acceptance criteria. In addition, the tow (fiber bundle) had poor visual appearance without commercial value.

Comparative Example 5

Free rollers of the drying apparatus shown in FIG. 2 were exchanged with driven rollers to conduct experiment. Rotational speeds of each driven rollers were adjusted so that the shrinkage of the fiber at a drying exit might give 7.0%, that is, a rotational speed of the exit driven roller might give 93% of a velocity of the entrance driven roller velocity. In addition, the velocity of the driven rollers within the drying chamber was gradually and uniformly reduced as approaching to the exit from the drying entrance. A drying temperature was set as 65 degree C. Four fiber bundles having 700 filaments were introduced into the drying apparatus, and a twist was applied to each of the fiber bundle at a ratio of 0.5 twists/m. Drying process was conducted using a fiber material having a fineness of a single fiber of 80 dtex, a thickness of a fiber bundle of 56000 dtex, and a gross size of 224000 dtex.

As a result, the tension unevenness within the drying apparatus showed almost same behavior as in Comparative Example 4 to give a value increased to 0.205 g weight/dtex (115 N/700 f) at the maximum. Thereby, although this Comparative Example 5 gave the shrinkage of the fiber at the drying exit a same value of 7% as in Example 1, fiber breakage occurred within the dryer. A number of fluff gave 300 times/700 f×72 m, and a hackling loss rate gave a very large value of 7.4%, failing to reach to acceptance criteria. In addition, the tow (fiber bundle) had poor visual appearance without commercial value.

Comparative Example 6

Figure 5:
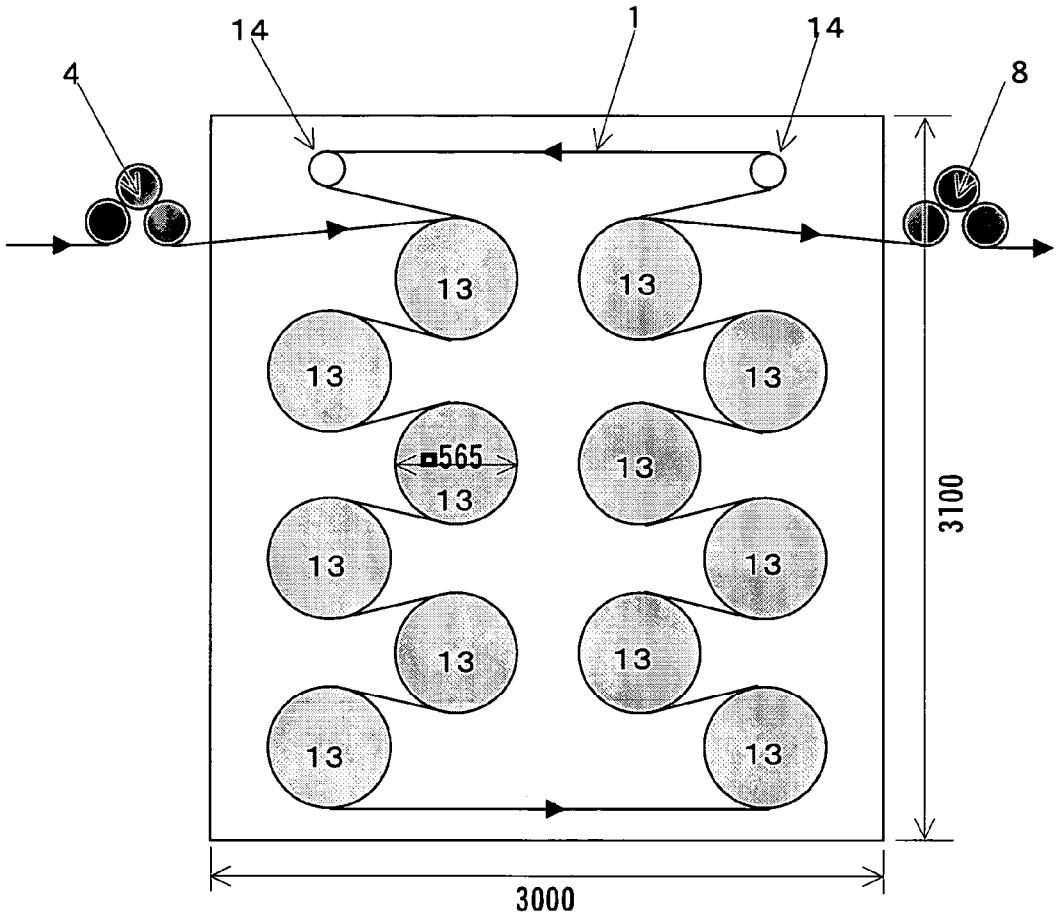
FIG. 5 is a schematic view of a heat roller dryer (Comparative Example 6).

FIG. 5 shows schematic view of a heat roller dryer. Experiment was conducted using a dryer having 12 heat rollers with a diameter of 565 mm, and a width of 500 mm. Tows (fiber bundle) were managed to return from an exit side to heat rollers 13 in an entrance side via a guide roller 14, and then the tows were managed to turn 12 times on the heat rollers by adjustment of an angle of the guide roller. The heat roller was a straight drum type heat roller, each heat roller was driven with a constant velocity, and the shrinkage of the fiber under drying was set as 0%. A drying temperature was set as 60 to 70 degree C. The fiber bundle introduced into the dryer had 700 filaments, and a twist was applied at a ratio of 0.5 twists/m. A fineness of a single fiber was 80 dtex, and a thickness of the fiber bundle was 56000 dtex.

As a result, a tension under drying showed a value more than 0.214 g weight/dtex (120 N/700 f) to give breakage of the tows (fiber bundle), disabling operation continuation.

TABLE 2

Relationship between drying conditions, and the number of fluff (the number of fiber breakage), hackling loss rate and curl retentive property in Examples 10, 11, and Comparative examples 1 to 6

| Roll configuration within a dryer | | Count of twists (twists/m) | Drying temperature (degree C.) | Tension of a fiber bundle (g weight/dtex) Entrance tension | Exit tension | Minimum tension | Maximum tension | Fiber shrinkage at exit of drying (%) | Number of fluff (fiber breakage) (times/700 f * 72 m), Acceptance criterion: not more than 36 | Hackling loss rate (%) Acceptance criterion: not more than 1.0% | Curl retentive property | Remarks |
|---|---|---|---|---|---|---|---|---|---|---|---|---|
| Free roller | Comparative Example 1 | 0 | 65 | 0.018 (10) | 0.036 (20) | 0.018 (10) | 0.036 (20) | 7 | about 200 | 5.2 | A | Tow breakage occurred during processing |
| | Example 10 | 0.17 | 65 | 0.018 (10) | 0.036 (20) | 0.018 (10) | 0.036 (20) | 7 | about 100 | 3.4 | A | |
| | Example 11 | 10 | 65 | 0.018 (10) | 0.036 (20) | 0.018 (10) | 0.036 (20) | 7 | 23 | 0.3 | A | Fiber not straight |
| | Comparative Example 2 | 0.5 | 65 | 0.005 (3) | 0.018 (10) | 0.005 (3) | 0.018 (10) | 11 | 6 | 0.1 | B to C | |
| | Comparative Example 3 | 0.5 | 65 | 0.066 (37) | 0.089 (50) | 0.066 (37) | 0.089 (50) | 2 | about 150 | 4 | A to B | |
| Nelson roller | Comparative Example 4 | 0.5 | 65 | 0.046 (26) | 0.045 (25) | 0.020 (11) | 0.214 (120) | 7 | about 300 | 7.8 | — | Poor tow visual appearance |
| Driven roller | Comparative Example 5 | 0.5 | 65 | 0.036 (20) | 0.045 (25) | 0.018 (10) | 0.205 (115) | 7 | about 300 | 7.4 | — | Poor tow visual appearance |

TABLE 2-continued

Relationship between drying conditions, and the number of fluff (the number of fiber breakage), hackling loss rate and curl retentive property in Examples 10, 11, and Comparative examples 1 to 6

| Roll configuration within a dryer | | Count of twists (twists/m) | Drying temperature (degree C.) | Tension of a fiber bundle (g weight/dtex) Entrance tension | Exit tension | Minimum tension | Maximum tension | Fiber shrinkage at exit of drying (%) | Number of fluff (fiber breakage) (times/700 f * 72 m), Acceptance criterion: not more than 36 | Hackling loss rate (%) Acceptance criterion: not more than 1.0% | Curl retentive property | Remarks |
|---|---|---|---|---|---|---|---|---|---|---|---|---|
| Heat roller | Comparative Example 6 | 0.5 | 60 | 0.004 (2) | — | 0.004 (2) | not less than 0.214 | 0 | Not measurable by tow breakage occurrence | — | — | |

Tension of fiber bundle: ( ) Unit of numerical value N/700 f

The invention claimed is:

1. A method for manufacturing a head decorating regenerated collagen fiber, comprising the steps of:

giving twists to a fiber bundle introduced into a drying chamber; and continuously drying the fiber bundle by controlling a tension of the fiber bundle so that the fiber bundle under drying gives a tension in a range of 0.01 to 0.08 g weight/dtex.

2. The method for manufacturing a head decorating regenerated collagen fiber according to claim 1, wherein the twists is given to the fiber bundle at a ratio of 0.2 to 5 twists/m.

3. The method for manufacturing a head decorating regenerated collagen fiber according to claim 1 or 2, wherein a value of a tension at an exit side of a drying chamber is controlled within a range of 0.02 to 0.08 g weight/dtex.

4. A continuous drying apparatus comprising:

driven rollers installed in an entrance and an exit of a drying chamber;

a tension detecting element installed in a drying chamber side of an exit driven roller;

a mechanism for controlling a rotational speed of the driven roller so that a tension at a drying chamber exit detected with the tension detecting element gives a desired value; and a freely rotatable roller for managing the fiber bundle to go and return at least once within the drying chamber, the free roller being installed at a predetermined interval between the exit and the entrance.

5. A method for manufacturing a head decorating regenerated collagen fiber according to claim 1 or claim 2, wherein drying is performed by controlling a rotational speed of an entrance driven roller constant, and by controlling a rotational speed of the exit driven roller using the continuous drying apparatus according to claim 4.

6. A method for manufacturing a head decorating regenerated collagen fiber according to claim 1 or claim 2, wherein drying is performed by controlling a rotational speed of the exit driven roller constant, and by controlling a rotational speed of the entrance driven roller using the continuous drying apparatus according to claim 4.

* * * * *